US005227699A

United States Patent [19]

Busta

[11] Patent Number: 5,227,699

[45] Date of Patent: Jul. 13, 1993

[54] RECESSED GATE FIELD EMISSION

[75] Inventor: Heinz H. Busta, Park Ridge, Ill.

[73] Assignee: Amoco Corporation, Chicago, Ill.

[21] Appl. No.: 746,355

[22] Filed: Aug. 16, 1991

[51] Int. Cl.[5] ..... H01J 19/24

[52] U.S. Cl. ..... 315/291; 313/309; 313/336

[58] Field of Search ..... 315/169.1, 169.3, 169.4, 315/357; 313/307, 309, 308, 336, 351, 146

[56] References Cited

U.S. PATENT DOCUMENTS

| | | | |
|---|---|---|---|
| 3,246,259 | 4/1966 | Stanish | 315/357 |
| 3,671,798 | 6/1972 | Lees | 313/336 |
| 4,528,474 | 7/1985 | Kim | 313/308 X |
| 4,721,885 | 1/1988 | Brodie | 313/309 X |
| 4,827,177 | 5/1989 | Lee et al. | 313/306 |
| 4,908,539 | 3/1990 | Meyer | 315/169.3 |
| 4,940,916 | 7/1990 | Borel et al. | 313/309 X |
| 5,003,216 | 3/1991 | Hicks | 313/309 X |
| 5,055,077 | 10/1991 | Kane | 313/309 X |

OTHER PUBLICATIONS

A Vacuum Field Effect Transistor Using Silicon Field Emitter Arrays, by Gray, 1986 IEDM.

*Primary Examiner*—Eugene R. LaRoche
*Assistant Examiner*—Son Dinh
*Attorney, Agent, or Firm*—Steven G. Mican

[57] ABSTRACT

Methods and apparatus for providing signal modulation or control of collector initialized and sustained field emission in field emitter devices without input circuit loading. A special control gate is used to modulate emission with no resultant steady-state emitter-gate current, thus increasing input resistance. The control gate may be well spaced from the emitter tip and the collector because it is not used to initiate and sustain emission from the emitter. This lowers emitter-gate and collector gate capacitances, thereby increasing input reactance for high frequency input signals. The collector-sustained field emission provides a low output resistance with relatively great collector-emitter spacing to provide high output reactance so that the high frequency response is extended.

20 Claims, 21 Drawing Sheets

RECESSED GATE FIELD EMISSION

BACKGROUND OF THE INVENTION

This invention relates to triode type field emitter devices for high frequency amplification and switching systems, and more particularly to methods and apparatus for operation of such devices with collector initiated, gate modulated field emission.

Field emission devices for signal switching and amplification that utilize structures with one or more field emitters are well known in the art. These devices may be fabricated on a substrate with a configuration that is arranged laterally or vertically with respect to a planar surface of the substrate. Such devices have been designed with well known configurations such as electron sources, diodes and triodes. Electron sources generally comprise a field emitter with a proximate extraction gate control electrode that initiates and controls current flow from the tip of the field emitter toward and through the extraction gate according to the well known Fowler-Nordheim relationship between field emission and electric field applied to the emitter by the extraction gate. The extraction gate has at least one aperture through it to allow some proportion of the emitter field emission to pass through the gate.

Diodes generally comprise the field emitter with a proximate extraction control electrode or collector that initiates and controls current flow from the tip of the field emitter to the collector according to the Fowler-Nordheim relationship. Triodes generally comprise the field emitter with a combination of the collector and an intermediately positioned extraction gate control electrode. The electric field applied to the emitter by the extraction gate serves to initiate and control the current flow to the collector according to the Fowler-Nordheim relationship. The collector in turn collects the emission from the emitter that passes through the extraction gate.

Using known field emitter devices, field emission from the emitter requires that the extraction gate must always be maintained at some positive potential relative to the emitter, because in such devices the emission is initiated and sustained only because of the field applied to the emitter tip according to the Fowler-Nordheim relationship. In contrast, the potential applied to the collector has only a small effect upon emission and collector current.

Known field emitter devices have several serious disadvantages that limit their use for high frequency signal amplifiers and flat panel fluorescent displays. One of these disadvantages is the high gate-to-emitter capacitance that is caused by the close proximity of the gate apertures to the emitter tips. The close proximity, typically in the range of 0.5 to 1.0 μm, is necessary to achieve low device turn-on potential, typically in the range of 60 to 100 V. This high input capacitance limits the high frequency performance of these devices due to capacitive reactance.

Another disadvantage of known field emitter devices is the high gate leakage current that occurs at moderate collector potentials. The gate leakage current increases proportionately as collector potential decreases because the number of electrons that have their paths redirected from the gate to the collector diminishes.

Still another disadvantage is high dynamic output resistance. This occurs because the field emission initiated by the extraction gate limits the number of electrons that can reach the collector, so that saturation of collector current develops with even moderate collector potentials. The high resulting output resistance makes efficient high frequency output coupling difficult when even small amounts of capacitive reactance are present in the output circuit.

SUMMARY OF THE INVENTION

The present invention provides reduced input capacitance, reduced output resistance and negligible gate current for field emitter devices that comprise a field emitter, a control gate and a collector with methods and apparatus for initiating and sustaining field emission with the collector and modulating the emission with the control gate. The control gate may be used to modulate emission with no resultant steady-state emitter-gate current, thus increasing input resistance. The control gate may be well spaced from the emitter tip and the collector because it is not used to initiate and sustain emission from the emitter. This lowers emitter-gate and collector gate capacitances, thereby increasing input reactance for high frequency input signals. The collector-sustained field emission provides a low output resistance with relatively great collector-emitter spacing to provide high output reactance so that the high frequency response is extended.

In the preferred embodiment, the methodology of the invention for controlling collector current in a field emitter device comprising an emitter and a collector comprises the steps of: applying a positive potential to said collector to initiate and sustain field emission between said emitter and said collector along a field emission path; positioning a control gate outside said field emission path to prevent significant emission between said emitter and said control gate; and applying a control potential to said control gate to modulate said field emission between said emitter and said collector.

In the preferred embodiment, the invention comprises: at least one field emitter for providing field emission current; a collector for initiating and sustaining field emission current from said field emitter along a field emission path; and at least one control gate positioned away from said field emission path and spaced a greater distance from said collector than the spacing of the emission surface of said field emitter from said collector.

DESCRIPTION OF THE INVENTION

Figure 1:
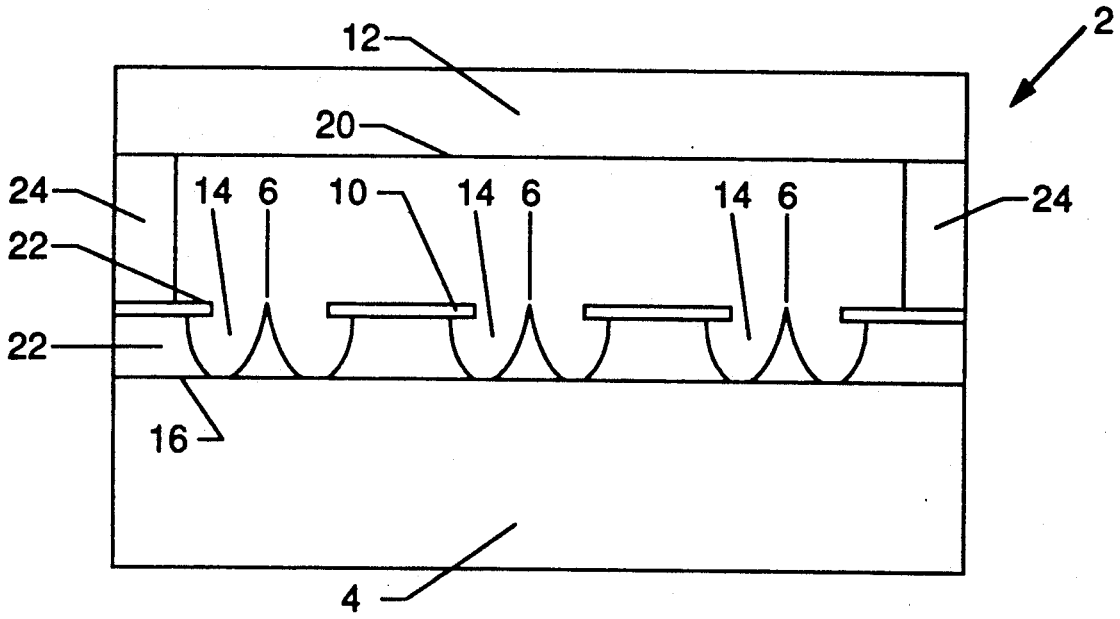
Prior Art Figure 1
FIG. 1 is a schematic diagram of a typical field emitter device with a vertical structure according to the prior art.

Referring to the drawings, wherein reference characters designate like or corresponding parts throughout the views, FIG. 1 is a schematic diagram of a typical field emitter triode 2 with a vertical structure according to the prior art. The triode 2 comprises an electrically conductive substrate 4, at least one field emitter 6, an electrically insulative spacing layer 8, at least one extraction gate control electrode 10 and at least one collector element 12.

Typically, the field emitter triode 2 comprises an array of the emitters 6 with emission controlled by a single extraction gate 10, as shown in FIG. 1. In this case, the extraction gate 10 comprises a single conductive layer that has a plurality of apertures 14 that are horizontally aligned over each of the emitters 6. The extraction gate 10 is supported on, and electrically insulated from, the substrate 4 by the spacing layer 8.

The substrate 4 is typically a conductive silicon wafer with at least one planar surface 16. The emitters 6 are typically protrusions on the planar surface 16 of the substrate 4. They are typically clad with a material that has a relatively low work function, such as molybdenum or tungsten, to increase emission. Of course, they may comprise solid protrusions of a low work function material instead.

The array of emitters 6 are typically formed on the substrate 4 by an etching technique that removes the entire surface of the substrate 4 except for the protrusions that comprise the emitters 6. The emitters 6 typically have a height on the order of 1 μm. The protrusions are left in silicon or are then clad with a low work function material with a coating technique such as chemical vapor deposition or sputtering that can be followed by ion implantation.

The spacing layer 8 is an insulative material, such as silicon dioxide. The spacing layer 8 is typically formed by thermal oxidation of the surface of the substrate 4. Practical manufacturing considerations, including thermal stress formed in the substrate 4 and the processing time, limit the thickness of the spacing layer 8 to the range of approximately one half to 2 μm, with approximately 1 μm being representative of the prior art. The apertures 14 typically have a diameter of approximately 1 μm.

The collector element 12, typically comprising a metallic plate, has a substantially planar collector inward surface 20 that is electrically conductive and held in a substantially parallel spaced relationship to a substantially planar outward surface 22 of the extraction gate 10 by an insulative ring 24 that circumscribes the perimeter of the extraction gate 10. The insulative ring 24 typically comprises a Pyrex glass ring that is secured to the inward surface 20 of the collector 12 and the outward surface 22 of the extraction gate 10 by thermal bonding.

Capacitance between the extraction gate 10 and the array of emitters 6 in combination with the conductive substrate 4 limits high frequency switching or modulation of the emission of the array of emitters 6 by the extraction gate 10. This is because the reactance $X_c$ of the gate-emitter capacitance $C_{ge}$ decreases rapidly with increasing gate signal frequency $f_s$, as represented by the relationship:

$$X_c = 1/(2 \cdot \pi \cdot f_s \cdot C_{ge})$$

The gate-emitter capacitance $C_{ge}$ in the triode 2, as a function of its area A, the free space dielectric constant $e_o$, the dielectric constant e of the spacing layer 8 and the thickness t of the spacing layer 8 is represented by the relationship:

$$C_{ge} = (A \cdot e_o \cdot e)/t$$

The gate-emitter capacitance per unit area $C_{ge}/A$ is thus:

$$C_{ge}/A = (e_o \cdot e)/t$$

With the free space dielectric constant $e_o$ equal to $8.86 \cdot 10^{-16}$ F/m, the dielectric constant e of the silicon dioxide spacer layer 8 equal to 3.9 and the thickness t of the spacer layer 8 equal to 1 μm, the value of $C_{ge}/A$ in this instance, ignoring gate-emitter tip capacitance, is:

$$C_{ge}/A = (8.86 \cdot 10^{-16} \cdot 3.9)/10^{-6} = 3.46 \cdot 10^3 pF/cm^2$$

This value of capacitance per unit area is unacceptable for switching or modulating applications with control signals having frequencies in the GHz range that are applied to the extraction gate 10. The corresponding reactance will be so small for any triode 2 of reasonable size that the high frequency control signals will be excessively loaded by the triode 2. Furthermore, leakage currents through the thin spacing layer 8 will further load down control signals that are applied to the extraction gate 10.

In addition, because the extraction gate 10 is used to initiate and sustain emission from the emitters 6, the extraction gate 10 must be mounted close to the tip of the emitters 6 to produce useable emission current at reasonable bias potentials that generally must be less than approximately 100 V. However, this means that the extraction gate 10 must be operated at a positive potential relative to the emitters 6 to produce usable emission, thus giving rise to emitter-gate current flow. This emitter-gate current flow can cause low input circuit resistance at moderate collector potentials, thus loading down control signals applied to the extraction gate 10. The close emitter-gate spacing also causes high emitter-gate capacitance, thus creating low input circuit reactance for high frequency control signals applied to the extraction gate 10. The combination of the low input resistance and reactance provides a low input impedance for the input circuit that can severely load down high frequency input signals that are applied to the extraction gate 10.

Figure 2:
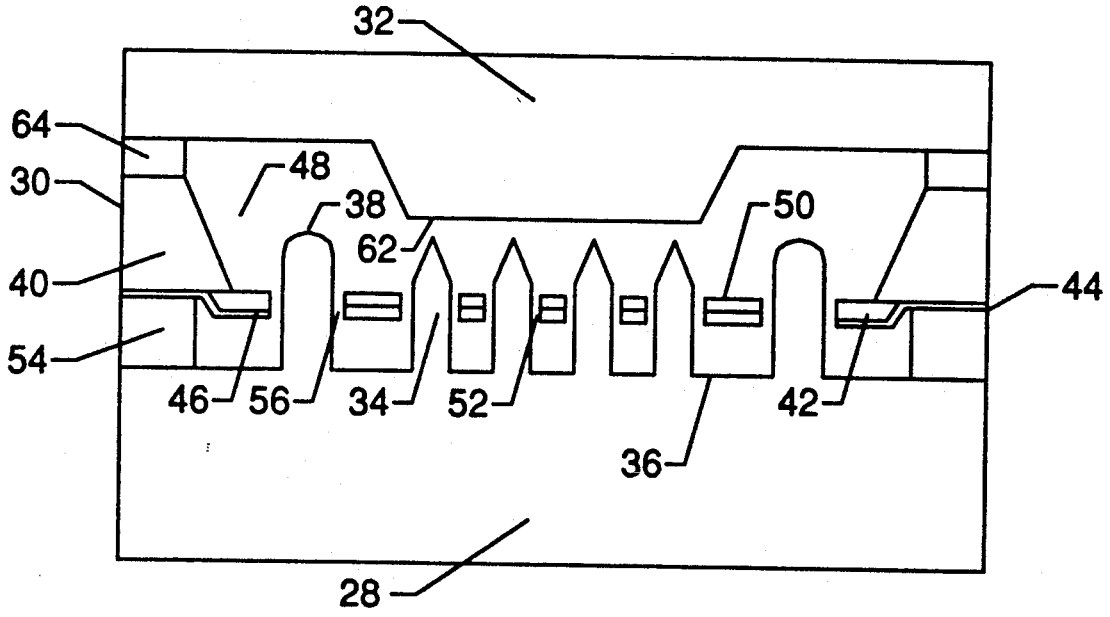
FIG. 2 is a schematic diagram of a field emitter device with a vertical structure according to the invention.

FIG. 2 is a schematic diagram of a preferred embodiment of a field emitter triode 26 with a vertical configuration according to the invention. The triode 26 comprises an emitter substrate 28, a control gate substrate 30 and an collector element 32. The emitter substrate 28 preferably comprises an electrically and thermally conductive material of low emission work function, such as monocrystalline tungsten or molybdenum. The emitter substrate 28 typically has a generally cylindrical or polyhedral shape.

The emitter substrate 28 has at least one field emitter structure 34 that extend from, and have an axis substantially perpendicular to, a substantially planar outward surface 36 of the emitter substrate 28. Typically, an array of the field emitters 34 extend from the planar surface of the emitter substrate 28. The emitter substrate preferably has at least two alignment pin structures 38 that extend from, and have an axis substantially perpendicular to, the planar surface 36 of the emitter substrate 28.

The control gate substrate 30 comprises a base 40, a control gate support membrane 42 and a control gate layer 44 that extends along a substantially planar inward surface 46 of the control gate support membrane 42. The base 40 preferably comprises conductive silicon, and it has a central aperture 48 that extends around the periphery of the control gate membrane 42 on an outward surface 50 of the control gate support membrane 42 opposite the inward surface 46.

The control gate membrane 42 comprises a layer of electrically insulative material, such as silicon nitride ($Si_3N_4$). The control gate membrane 42 has at least one aperture 52 extending from the inward surface 46 to the outward surface 50. Typically, the control gate membrane 42 has a plurality of the apertures 52, with at least one of the field emitters 34 protruding through each of the apertures 52. The control gate membrane 42 also has at least two alignment apertures 56, with each one of the alignment pins 38 protruding through a respective one of the alignment apertures 56.

The control gate layer 44 preferably comprises a metallic film, such as a tungsten or molybdenum film, that is formed on the control gate membrane 42 by chemical vapor deposition or sputtering. The control gate layer 44 is preferably formed on an inward surface 46 of the control gate membrane 42. The control gate substrate 30 is held with the control gate layer 44 on the control gate membrane 42 fixed in a substantially parallel spaced relationship with the outward surface 36 of the emitter substrate 28 by an insulative spacer 54. The insulative spacer 54 preferably comprises a Pyrex glass ring that is secured to the outer periphery of the control gate layer 44 on the control gate membrane 42 and the outward surface 36 of the emitter substrate 28 by electrostatic/thermal bonding.

Figure 3:
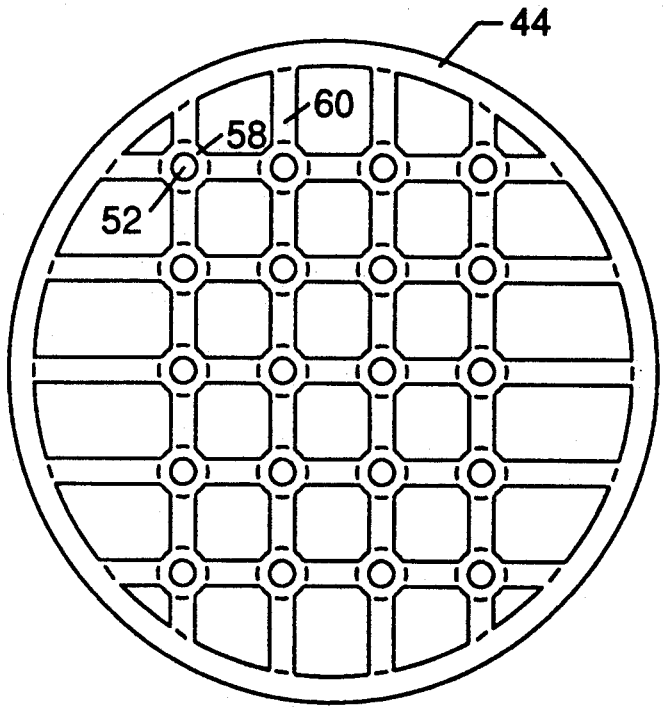
FIG. 3 is a top view of one preferred pattern that is suitable for the control gate layer on the control gate substrate for the device shown in FIG. 2.

The control gate layer 44 is preferably patterned, such as by masking, to achieve the combination of high gate-emitter coupling to increase control signal induced field strength on the emitters 34 and minimal total surface area to reduce gate-emitter capacitance. FIG. 3 is a top view of one preferred pattern that is suitable for the control gate layer 44. The control gate layer 44 has at least one gate section 58. In FIG. 3, there is one gate section 58 for each of the emitters 34, with the apertures 52 passing through each of the gate sections 58. The gate sections 58 are connected to each other with coupling sections 60.

It is evident that the areas of the gate sections 58 and coupling sections 60 combined are significantly less than the area of the control gate membrane 42 that is proximate the emitter substrate 28. Consequently, the gate-emitter capacitance is reduced compared to an unpatterned control gate layer 44 that covers the entire area of the gate membrane 42 proximate the emitter substrate 28.

The collector element 32 preferably comprises an electrically and thermally conductive material that is suitable for use as an collector element, such as nickel or oxygen-free copper. The collector element 32 has an inward surface 62 that is substantially planar. The inward surface 62 is fixed in a substantially parallel relationship with the outward surface 50 of the control gate membrane 42 by an insulative spacer 64. The insulative spacer 64 preferably comprises a Pyrex glass ring that is secured to the periphery of the collector element 32 and the periphery of the base 40 by electrostatic/thermal bonding or other bonding means.

Figure 4:
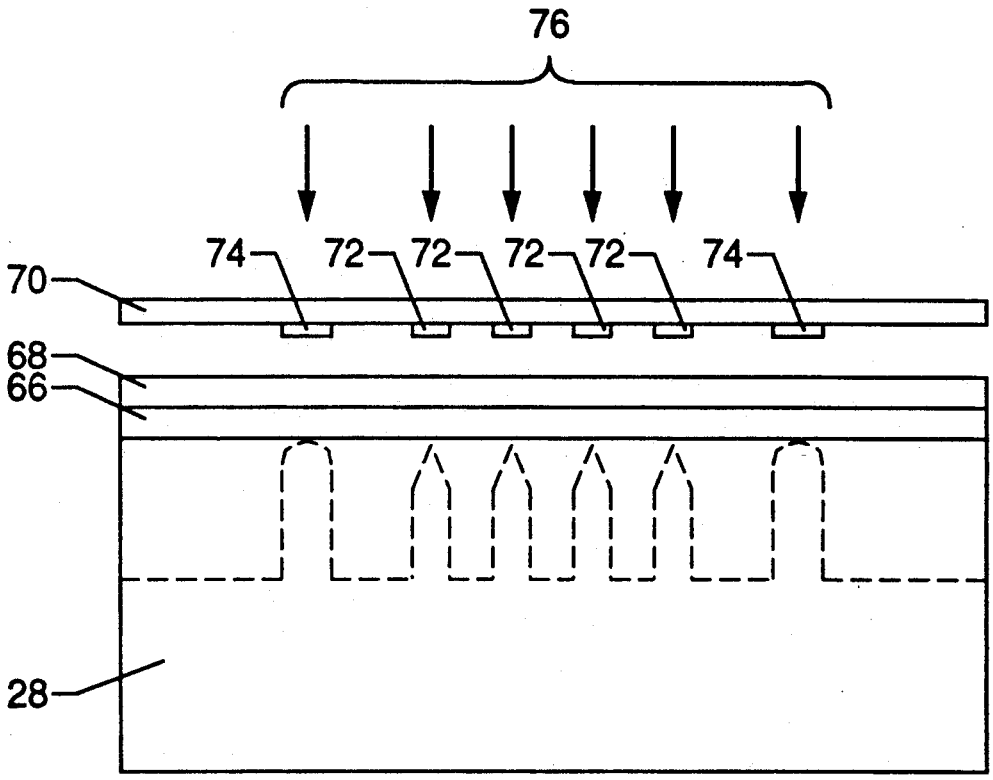
FIG. 4 shows the preparation of the emitter substrate to form the emitters and alignment pins that extend from the surface of the emitter substrate for the device shown in FIG. 2.

The preferred embodiment of a field emitter triode 26 with a vertical configuration according to the invention as described in connection with FIGS. 2 and 3 is preferably fabricated as shown in FIGS. 4 through 12. FIG. 4 shows the preparation of the emitter substrate 28 to form the emitters 34 and alignment pins 38 that extend from the surface 36. The emitter substrate 28 preferably comprises monocrystalline tungsten or molybdenum with a (111) orientation. One substantially planar surface of the unprocessed emitter substrate 28 is coated with a protective layer 66, preferably comprising $SiO_2$, most conveniently by the process of plasma enhanced chemical vapor deposition (PECVD). The protective layer 66 typically has a thickness in the range of 1 to 5 $\mu$m.

The protective layer 66 is then covered by a photoresist layer 68 using well known processing techniques. The photoresist layer 68 is typically in the range of 0.5 to 2 $\mu$m in thickness. The photoresist layer 68 is then exposed through a mask 70. The mask 70 has a pattern of opaque areas 72 through it that correspond to the pattern of the field emitters 34 on the emitter substrate 28. The size of the areas 72 are proportioned to establish the shape and size of the cross-sectional areas of each of the field emitters 34. For instance, in the preferred embodiment, each of the field emitters 34 have cross-sectional areas that are approximately round and in the range of approximately 2 to 6 $\mu$m in diameter.

Figure 5:
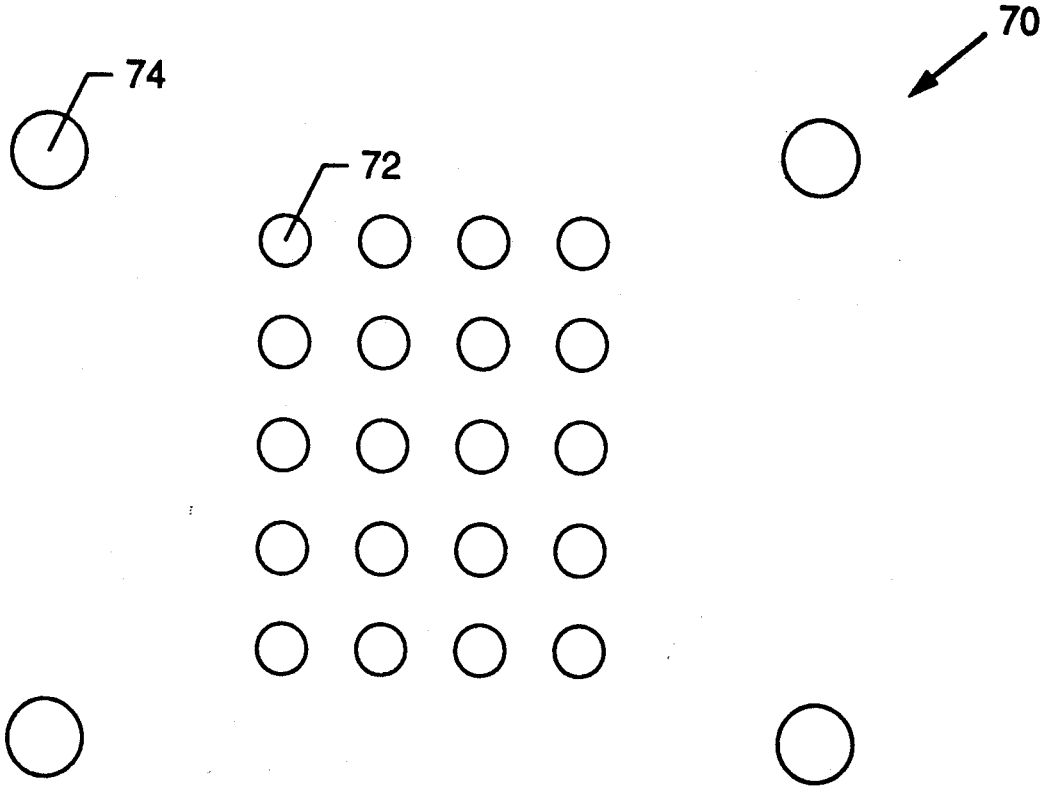
FIG. 5 is a preferred pattern for the mask to form the emitters and alignment pins that extend from the surface of the emitter substrate for the device shown in FIG. 2.

The mask 70 also has a pattern of opaque areas 74 that correspond to the pattern of the alignment pins 38 on the emitter substrate 28. The size of the areas 74 are likewise proportioned to establish the shape and size of the cross-sectional areas of each of the alignment pins 38. For instance, in the preferred embodiment, each of the alignment pins 38 have cross-sectional areas that are approximately round and in the range of approximately 5 to 20 μm in diameter. A preferred pattern for the mask 70 is shown in FIG. 5.

The photoresist layer 68 is then selectively exposed to light, represented by arrows 76, through the mask 70 except for the opaque areas 72 and 74. The photoresist layer 68 is chemically developed to remove all of the photoresist layer 68 except for the portions corresponding to the pattern of areas 72 and 74 not exposed to light through the mask 70.

Figure 6:
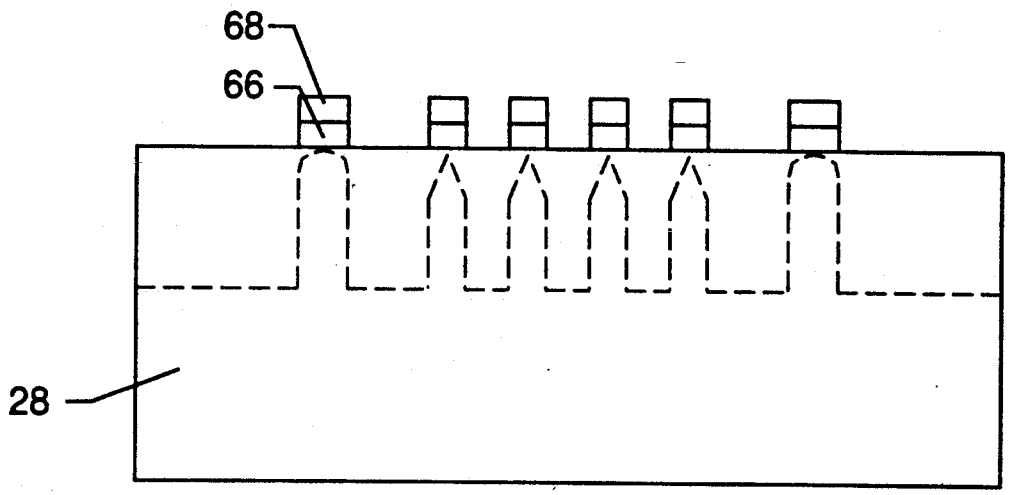
FIG. 6 is the pattern of islands on the emitter substrate used to form the emitters and alignment pins that extend from the surface of the emitter substrate for the device shown in FIG. 2.

The exposed surface of the protective layer 66 not covered by the remaining pattern of areas of the developed photoresist layer 68 is then removed, such as by reactive ion etching, wet chemical, or plasma etching techniques, to leave a pattern of islands comprising the protective layer 66 covered by the chemically developed photoresist layer 68 that register the positions and relative cross-sectional areas of the field emitters 34 and the alignment pins 38. The resulting pattern of islands is shown in FIG. 6.

Figure 7:
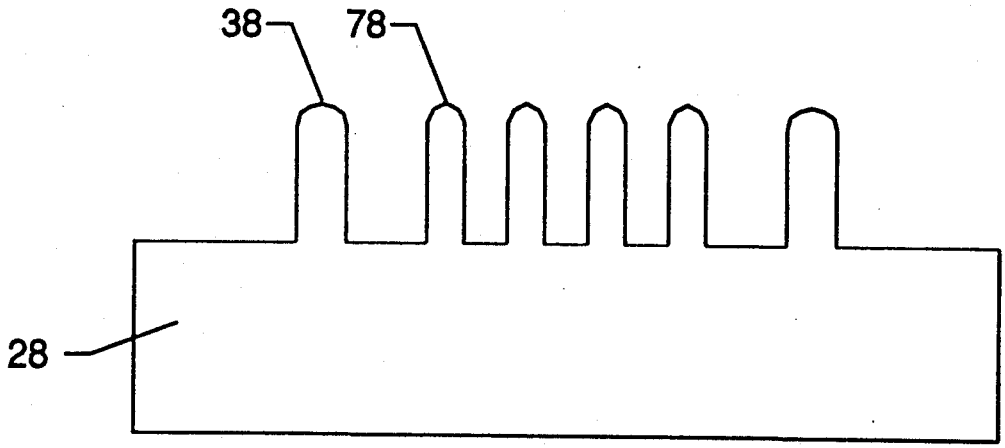
FIG. 7 shows the alignment pins and shanks of the field emitters in the emitter substrate for the device shown in FIG. 2.

The exposed surface of the emitter substrate 28 that has been exposed by removal of a portion of the protective layer 66 is then anisotropically etched using a reactive ion etching process in a chlorinated atmosphere to form the alignment pins 38 and shanks 78 of the field emitters 34 in the emitter substrate 28, as shown in FIG. 7. The shanks 78 preferably have a length of approximately 20 μm.

Figure 8:
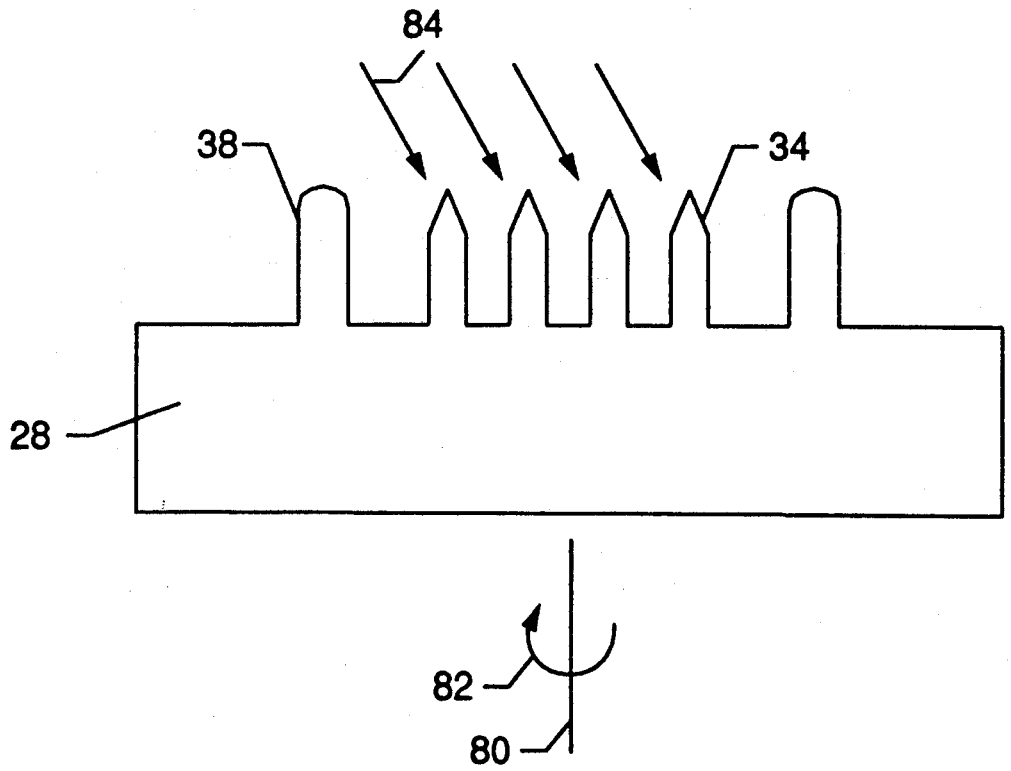
FIG. 8 shows how the field emitter shanks are sharpened by the process of ion beam milling to form the field emitters for the device shown in FIG. 2.

Finally, as shown in FIG. 8, the shanks 78 are sharpened by the process of ion beam milling to form the field emitters 34. The emitter substrate 28 is rotated about a central axis 80, the rotation represented by a curved arrow 82, while the shanks 78 are exposed to an ion beam, represented by arrows 84, that impinges the shanks 78 at an angle from the axis 80, typically in the range of approximately 0 to 30 degrees.

Figure 9:
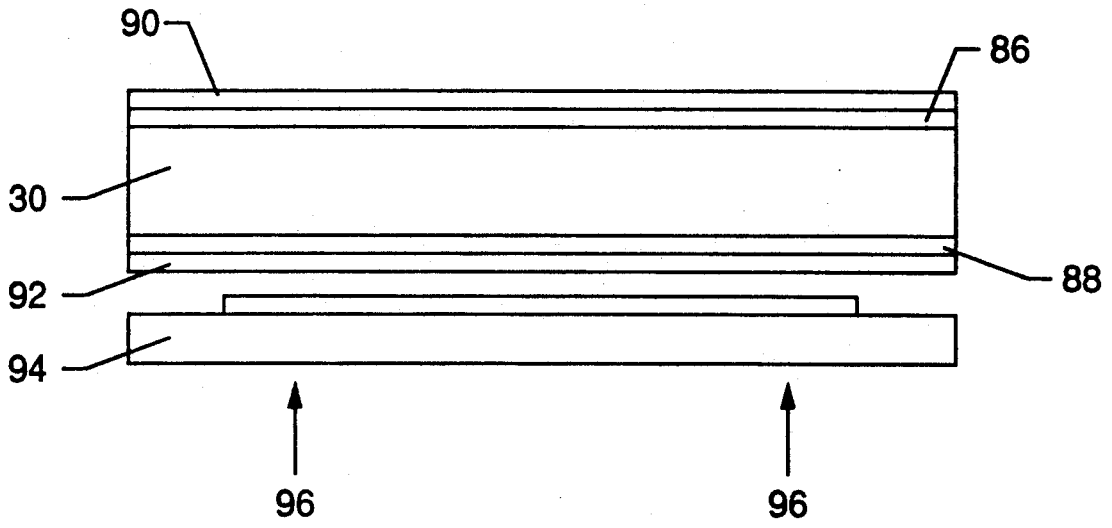
FIG. 9 shows the preparation of the control gate substrate for fabrication of its associated components for the device shown in FIG. 2.

FIG. 9 shows the preparation of the control gate substrate 30 for fabrication of its associated components. The unprocessed control gate substrate 30 preferably comprises conductive silicon. Opposite, substantially parallel and planar surfaces of the unprocessed control gate substrate 30 are each coated with layers of an insulative material, such as $Si_3N_4$, to form an outward protective coating 86 and an inward protective coating 88. The coatings 86 and 88 are preferably in the range of 1 μm in thickness, and preferably applied with the PECVD process.

Figure 10:
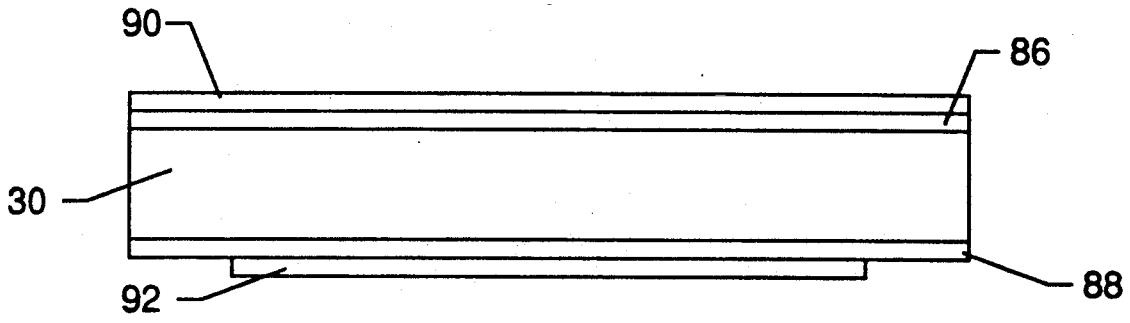
FIG. 10 shows a photolithographic processing step for fabricating the control gate substrate for the device shown in FIG. 2.

The control gate substrate 30 is fabricated by the technique of front side and back side photolithography. The coatings 86 and 88 are each coated with respective photoresist layers 90 and 92 using well known techniques. A mask 94 is then applied over the photoresist layer 92. The photoresist layer 92 is then exposed to light through the mask 94 as represented by arrows 96 and the photoresist layer 92 is developed. Only the portion of the photoresist layer 92 not exposed to light remains after development, as shown in FIG. 10.

The exposed regions of the protective layer 88 is then anisotropically etched to leave only the portions of the protective layer 88 covered by the remaining portions of the photoresist layer 92. The remaining portions of the photoresist layer 92 is then stripped. The metallic control gate layer 44 is then deposited over the remaining portion of the layer 88 and the exposed portion of the adjacent inward surface of the control gate substrate 30 that is to form the conductive base 40. The purpose of this step is to connect the control gate layer 44 to the base 40, thereby providing a convenient electrical control gate termination on the triode 26.

Figure 11:
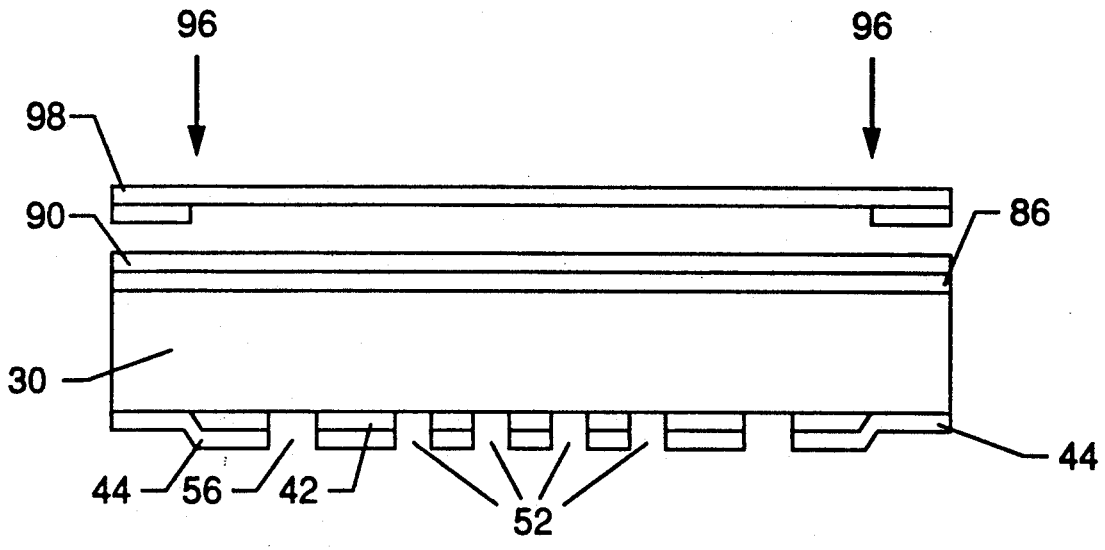
FIG. 11 shows another photolithographic processing step for fabricating the control gate substrate for the device shown in FIG. 2.

With another photolithographic process, the apertures 52 and 56 are formed in both the control gate layer 44 and the control gate membrane 42, as shown in FIG. 11. Finally, a mask 98 is applied over the photoresist layer 90, the photoresist layer 90 is then exposed to light through the mask 98 as represented by arrows 96 and the photoresist layer 90 is developed. Only the portions of the photoresist layer 90 not exposed to light remain after development.

Figure 12:
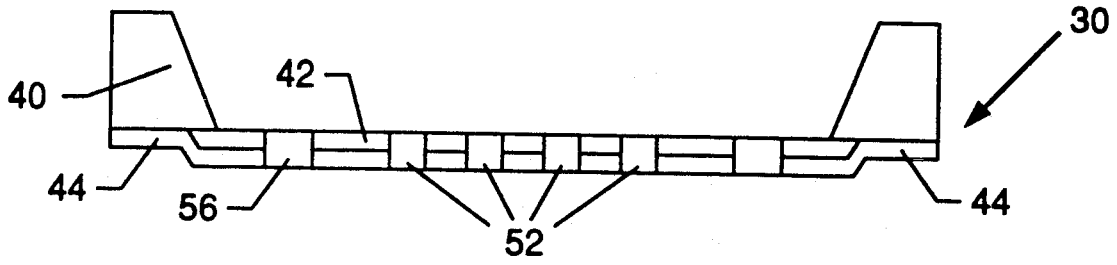
FIG. 12 shows the fabricated control gate substrate for the device shown in FIG. 2.

The exposed region of the protective layer 86 is then etched to leave only the portions of the protective layer 86 covered by the remaining portions of the photoresist layer 90. The remaining portions of the photoresist layer 90 are then stripped. The inward side of the control gate membrane 42 and the control gate layer 44 is covered with a layer of photoresist and the substrate 30 is etched in an anisotropic etch such as ethylenediamine pyrocatechol water (EPW) or KOH. The fabricated control gate substrate 30 is shown in FIG. 12.

Assembly of the field emitter triode 26 according to the preferred embodiment as described above is relatively simple because of the self-aligning features of the device. The insulative spacer 54 is first placed over the inward surface 36 of the emitter substrate 28. The control gate substrate 30 is then placed over the insulative spacer 54 so that the alignment pins 38 pass through the alignment apertures 56 in the control gate membrane 42. This feature insures that the field emitters 34 penetrate and center within their respective apertures 52 in the control gate membrane 42. The emitter substrate 28, the insulative spacer 54 and the control gate substrate 30 are then thermally bonded together.

The insulative spacer 64 is then placed over the outward peripheral surface of the base 40 of the control gate substrate 30. The collector element 32 is placed over the insulative spacer 64. The collector element 32, the insulative spacer 64 and the control gate substrate 30 are then thermally bonded together to complete the assembly of the triode 26.

Referring to FIG. 2, it is evident that the spacing between the outward emitter surface 36 and the control gate layer 44 is not limited by the thickness of an electrically insulative layer, such as the spacer layer 8 of the prior art device shown in FIG. 1. It is therefore possible to etch the emitter substrate 28 to form the field emitters 34 with a height that is much greater than the 1 μm thickness of the spacer layer 8 in the prior art device. For instance, in the preferred embodiment, the field emitters 34 are preferably in the range of approximately 20 μm in height. The height of the spacer 52 is sized to provide a gap in the range of approximately 3 to 5 μm between the outward surface 36 of the emitter substrate 28 and the control gate layer 44.

If the spacing between the control gate layer 44 and the outward surface 36 of the emitter substrate 28 is approximately 5 μm and the control gate layer 44 is unpatterned, the gate-emitter capacitance per unit area $C_{ge}/A$ in this instance will be approximately:

$$C_{ge}/A = e_0/t = 8.86 \cdot 10^{-16}/5 \cdot 10^{-6} = 177\ pF/cm^2$$

Of course, when the control gate layer 44 is patterned as described above, the gate-emitter capacitance per unit area $C_{ge}/A$ will be a fraction of this value, typically on the order of one fourth, or approximately 44 pF/cm$^2$. This is almost 80 times less than the prior art device shown in FIG. 1.

In the preferred embodiment, as shown in FIG. 2, the field emitters 34 each have tapered tips that terminate in a point. For instance, if the field emitters 34 extend on the order of 20 μm overall from the inward surface 36 of the emitter substrate 30, the tapered tips will have a length of approximately 3 μm.

The recessed-gate field emitter triode 26 according to the invention has many other advantages over field emitter amplifiers according to the prior art. Unlike prior art devices, field emission from the field emitters 34 is initiated and sustained by the field produced by the collector element 32 at the tips of the field emitters 34 due to collector potential according to the Fowler-Nordheim relationship, wherein J is the emission of the field emitters 34 in A/cm$^2$, $\phi$ is the work function of the field emitters 34 in eV, E is the electric field applied to the tips of the field emitters 34 in V/cm and:

$$J=(1.55\cdot10^{-6}\cdot E^2)\cdot\exp(-6.86\cdot10^7\cdot\phi^{3/2}\cdot v(y)/E)$$

with $$y=3.62\cdot10^{-4}\cdot E^{\frac{1}{2}}$$

and $$v(y)=\cos(\pi\cdot y/2)$$

The field produced by the control gate layer 44 at the tips of the field emitters 34 due to control gate potential according to the Fowler-Nordheim relationship is only used to modulate the emission initiated and sustained by the collector element 32. The recessed and relatively remote placement of the control gate layer 44 with respect to the tips of the field emitters 34 is ideal for this mode of operation, since an intense field need not be produced by the control gate layer 44 at the tips of the field emitter 34 with the emission primarily due to the field produced by the collector element 32, and the remote placement reduces interelectrode capacitances and prevents emitter-control gate current flow even when the control gate layer 44 has moderate values of positive potential relative to the field emitters applied to it. Most remarkably, and completely different from prior art devices, the field emitter triode 26 works satisfactorily with negative values of potential relative to the field emitters 34 applied to the control gate layer 44.

Because the collector current of the field emitter triode 26 is initiated and sustained by the positive potential relative to the emitter tips that is applied to the collector element 32, the field emitter triode 26 exhibits a much lower output resistance than prior art devices. The characteristic curves of the triode 26 are nearly that of a constant voltage source, similar to a thermionic triode. Prior art field emitter devices have characteristic curves that are nearly that of a constant current source, similar to a thermionic pentode. The high output resistance of the prior art devices, like thermionic pentodes, is due to the fact that the output current is primarily due to input signal potential.

The low output resistance of the field emitter triode 26 is a tremendous advantage over prior art devices for several reasons. The low output resistance allows the triode 26 to be used as an efficient power amplifier. The low output resistance also means that output signals will not be significantly attenuated by shunting reactance due to the output capacitance of the triode 26. When used as a potential amplifier, a simple impedance transformation network provides high potential gain with little attenuation due to capacitive reactance.

Figure 13:
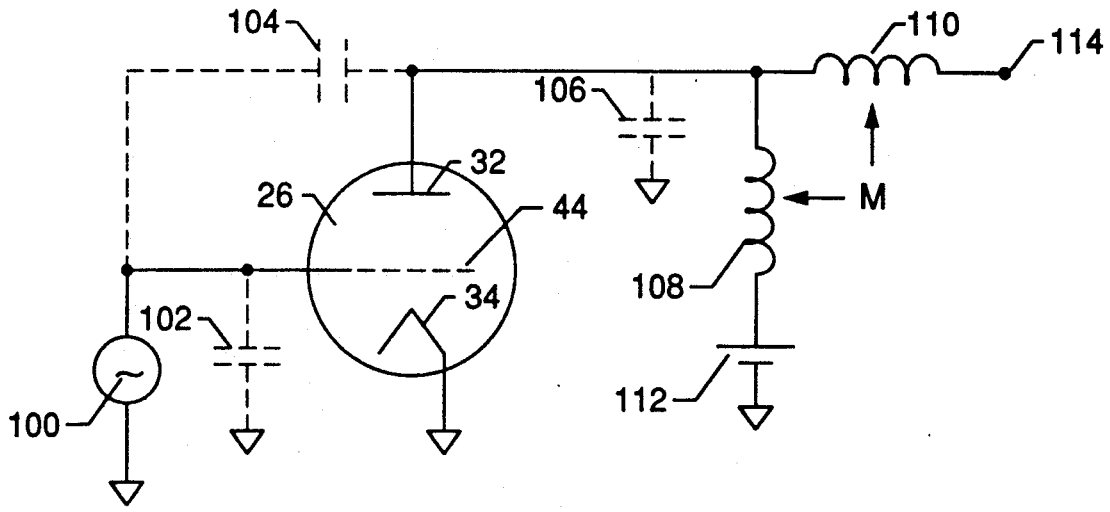
FIG. 13 is one high frequency circuit application of the invention.

This is shown in FIG. 13, wherein a high frequency signal source 100 is coupled to the control gate 44 of the triode 26. The emitter 34 is kept at ground potential. The input, or emitter-control gate capacitance, is represented by a capacitor 102 shown in dashed line between the control gate 44 and ground. The collector-control gate capacitance is represented by a capacitor 104 between the collector 32 and the control gate 44 in dashed line. The output capacitance is represented by a capacitor 106 between the collector 32 and ground.

The impedance transformation network comprises an inductance 108 and an inductance 110 having a mutual coupling factor M and a common connection to the collector 32. The other side of the inductance 108 is connected to a high potential collector source 112 that provides sufficient positive potential relative to the emitter 34 to initiate and sustain emission. The other side of the inductance 110 is a high impedance output terminal 114.

As well known in the art, for any frequency output signal wherein the inductors 108 and 110 have a suitable degree of mutual conductance, not considering losses, the signal output potential developed at the output terminal 114 $v_t$ in terms of the signal output potential developed at the collector $v_a$ and the turns ratio N of the inductance 110 to the inductance 108 is:

$$v_t=N\cdot v_a$$

Because the output resistance of the triode 26 is low, the inductance 108 may be made relatively small without power loss in the collector circuit of the triode 26. The turns ratio N may be made very high to develop a high output signal potential at the output terminal 114. Thus, the shunting effect of the capacitive reactance due to the output capacitance 106 may be made negligible even for high signal frequencies.

Figure 14:
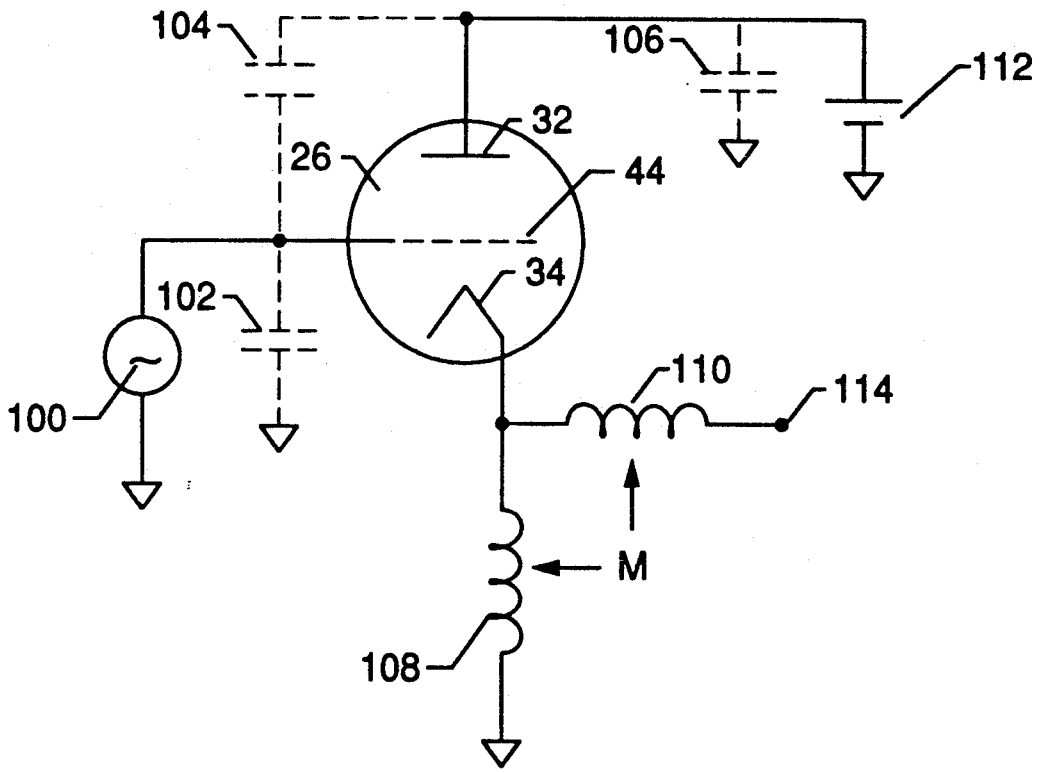
FIG. 14 another high frequency circuit application of the invention.

Furthermore, when the triode is used in an emitter-follower amplifier configuration as shown in FIG. 14, the input and output signals are in phase, so no neutralization is required for high frequency signal power amplification. This configuration is a simple rearrangement of the components shown in FIG. 13. The source 112 is connected directly to the collector 32 to hold the collector 32 at the potential supplied by the source 112.

In this way, destabilizing positive feedback cannot be fed from the collector 32 back to the control grid 44 through the capacitive reactance of the capacitor 104. The simple impedance transformation network, comprising the inductors 108 and 110, have their common connection made to the emitter 34, with the other side of the inductor 108 connected to ground and the other side of the inductor 110 connected to the output terminal 114.

Although the signal output potential developed at the emitter 34 is necessarily somewhat less than the input signal potential on the control gate 44, the signal output potential gain at the terminal 114 may be made very high, since this configuration provides high power gain very low output impedance, making a high value of turns ratio N possible without other significant losses coming into play, such as stray capacitances in the inductors 108 and 110.

Compared to prior art devices, the triode 26 handles a tremendous dynamic input signal range, because the output current may be modulated by control gate input signal levels that can be driven moderately positive and negative in potential relative to the emitter potential without output saturation or cutoff and without input signal loading due to emitter-control gate current.

Figure 15:
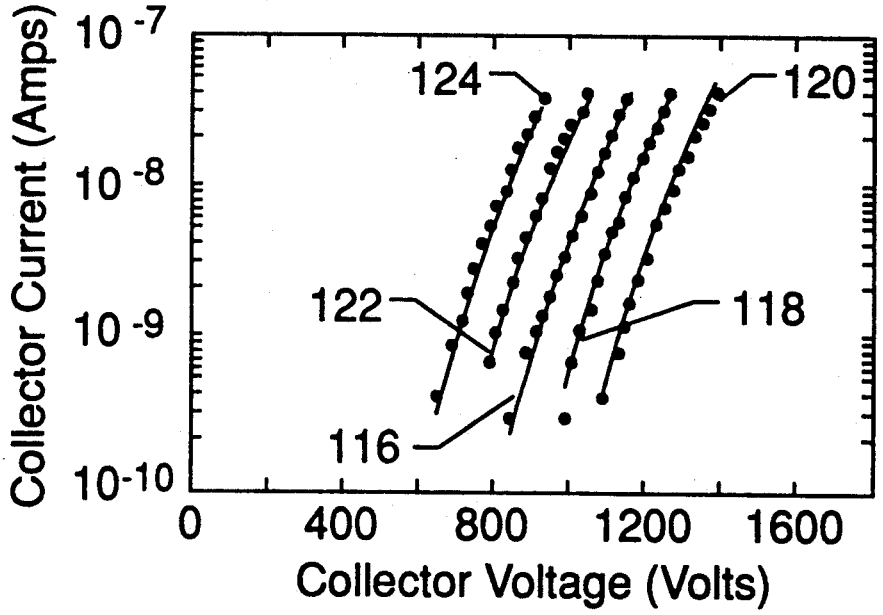
FIG. 15 shows the characteristic curves for a prototype device according to the invention.

FIG. 15 shows the characteristic curves for a prototype triode 26 with a single field emitter 34 according to the invention and a control gate 44 with a single aperture 52 through which the field emitter 34 protrudes. The total length of the field emitter 34 in this case is approximately 2 mm. The diameter of the field emitter is approximately 120 μm. The tip radius is approximately 20 nm. The spacing between the tip of the field emitter 34 and the collector 32 is approximately 3 mm. The field emitter 34 protrudes approximately 250 μm through the aperture 52 of the control gate 44. The aperture 52 has a diameter of approximately 380 μm.

FIG. 15 specifically represents the current of the collector 32 as a function of collector potential for different values of potential applied to the control gate 44. A line 116 represents collector current as a function of collector potential with a potential of 0 V applied to the control gate 44. A line 118 represents collector current as a function of collector potential with a potential of negative 20 V applied to the control gate 44. A line 120 represents collector current as a function of collector potential with a potential of negative 40 V applied to the control gate 44. It may be seen that the collector current for a given collector potential decreases substantially with increasing negative potential applied to the control gate 44.

A line 122 represents collector current as a function of collector potential with a potential of positive 20 V applied to the control gate 44. A line 124 represents collector current as a function of collector potential with a potential of positive 40 V applied to the control gate 44. It may be seen that the collector current for a given collector potential of the triode 26 increases substantially with increasing positive potential applied to the control gate 44.

Figure 16:
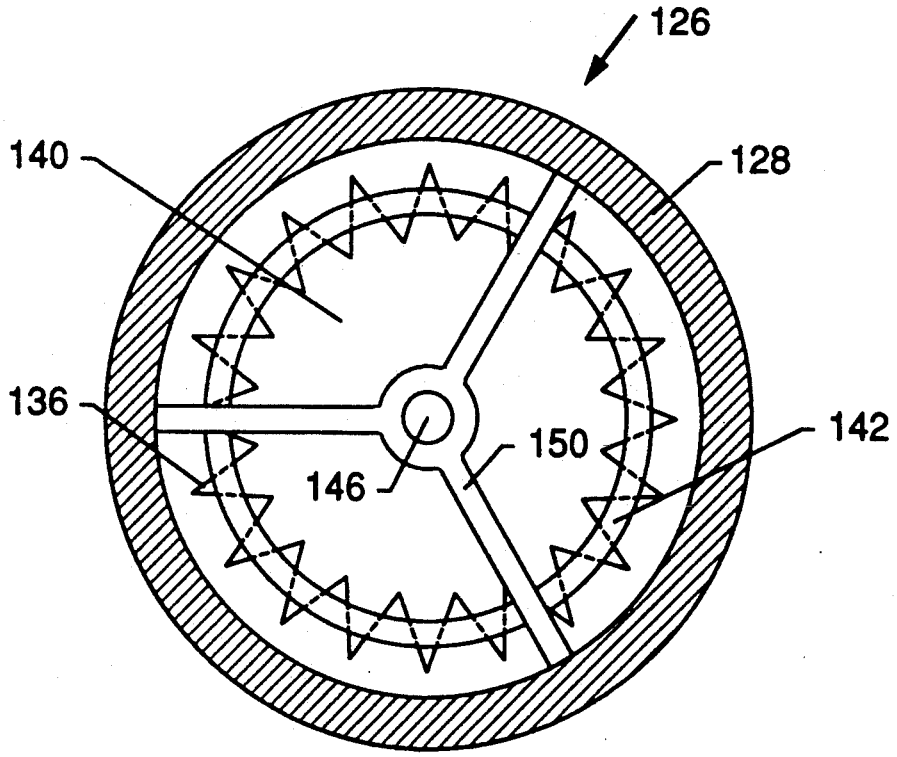
FIG. 16 is a top view of a first alternate embodiment of the invention.
Figure 17:
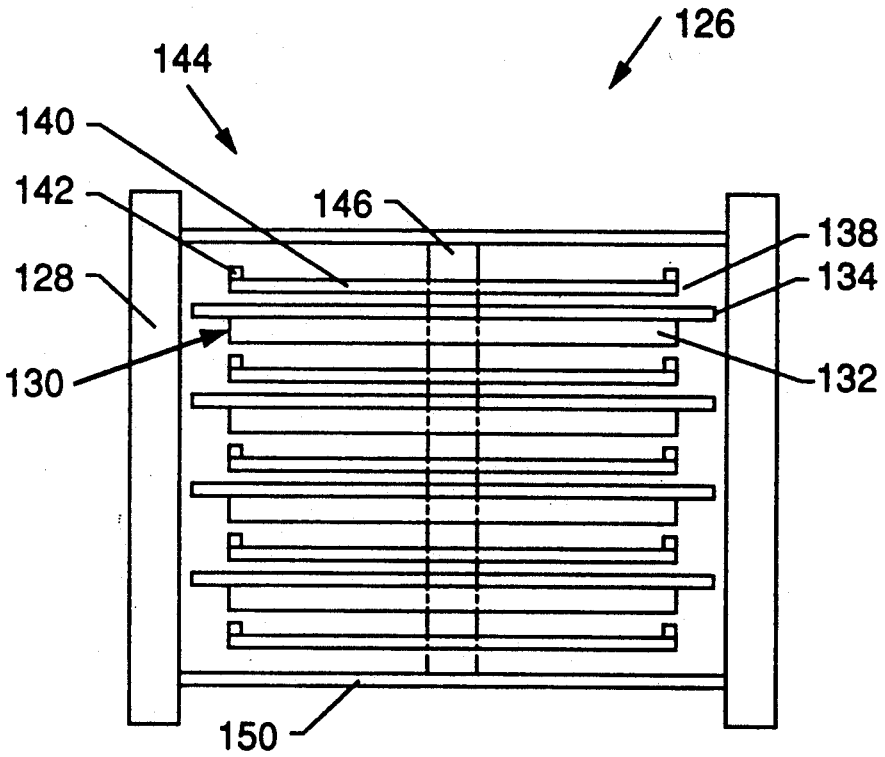
FIG. 17 is a side view of a first alternate embodiment of the invention.

The invention is also applicable to a lateral field emitter amplifier device. FIGS. 16 and 17 show top and side views, respectively, of a lateral field emitter triode 126 according to the invention. The lateral triode 126 preferably comprises an approximately cylindrical collector element 128. The collector element 128 preferably comprises an anodic material with good electrical and thermal conductivity, such as nickel or oxygen-free copper.

The triode 126 also comprises at least one substantially disc-shaped field emitter substrate 130. The field emitter substrate 130 preferably comprises a substantially disc-shaped support base 132 coupled to a substantially star-shaped field emitter plate 134 of a material with high electrical and thermal conductivity, as well as low emission work function. Each of the points of the star-shaped field emitter plate comprise a field emitter 136.

The triode 126 also comprises at least one substantially disc-shaped control gate substrate 138. The control gate substrate 138 preferably comprises a substantially disc-shaped support base 140 coupled to a substantially ring-shaped control gate 142 comprising a material of high conductivity, such as tungsten or molybdenum. Typically, a plurality of the field emitter substrates 130 and control gate substrates 138 are alternately stacked within a central aperture 144 of the collector 128 to provide a balanced, high transconductance structure. The substrates 130 and 138 are conveniently stacked on a spindle 146. The ends of the spindle 146 are conveniently centered within the aperture 144 of the collector 128 by spiders 150.

The characteristics of the triode 126 are similar to that of the triode 26 described in connection with FIG. 2. The triode 126 may be preferred for certain applications, such as microwave signal amplification, wherein the collector 128 may comprise a waveguide.

Figure 18:
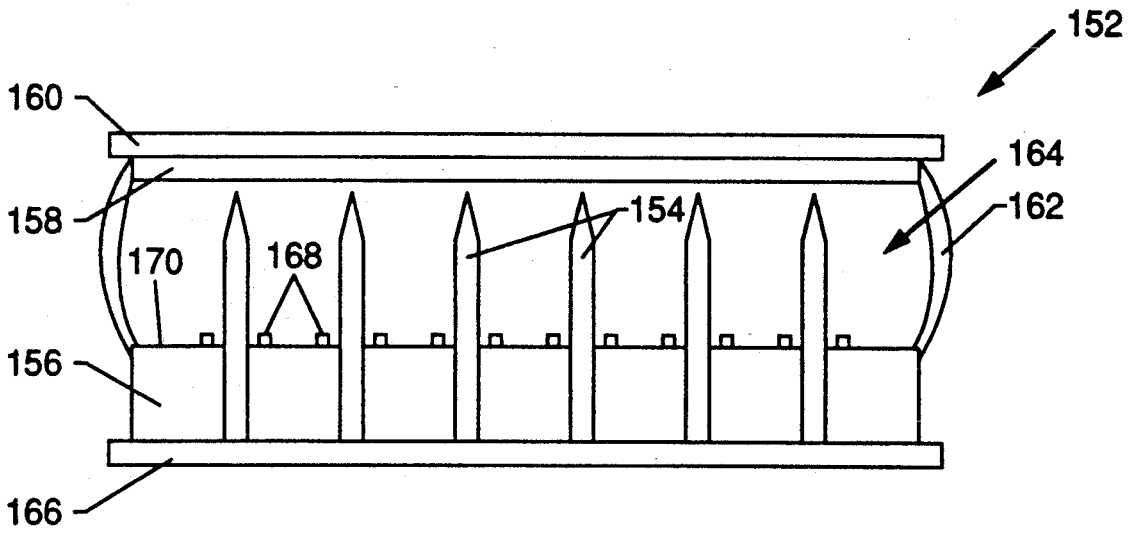
FIG. 18 is a side view of a second alternate embodiment of the invention.
Figure 19:
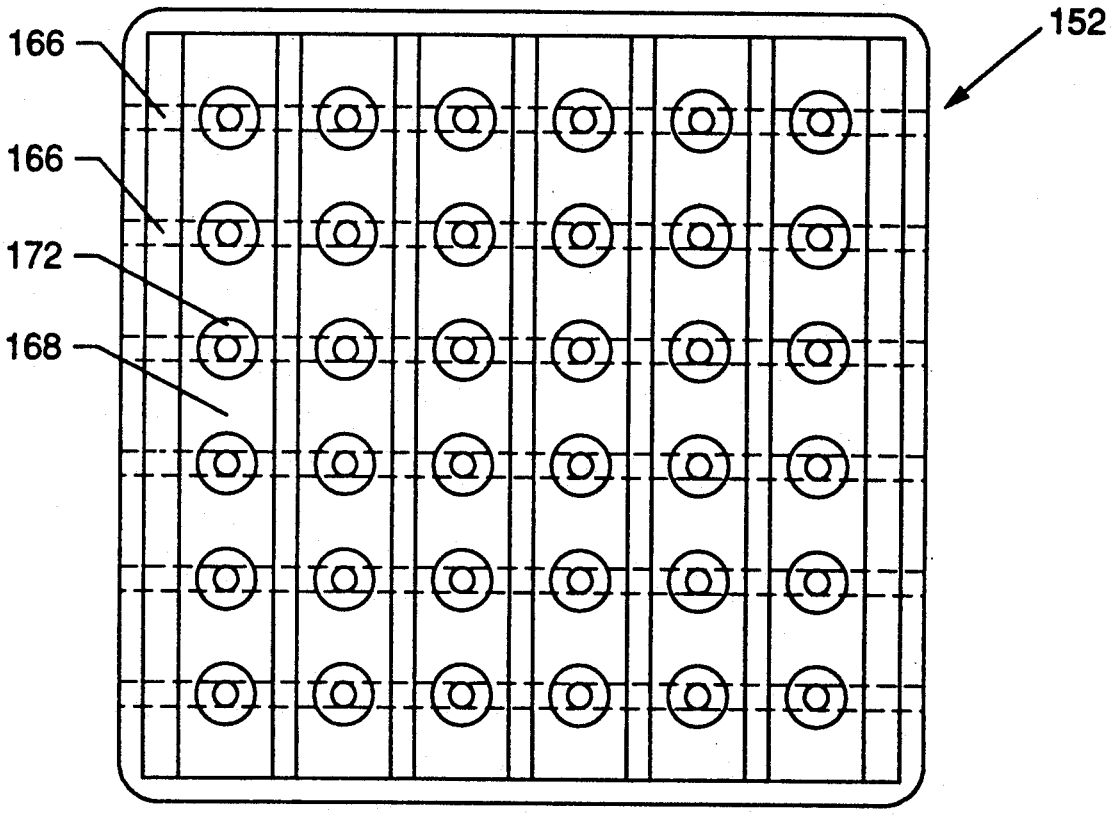
FIG. 19 is a top view of a second alternate embodiment of the invention.

The invention is also ideal for electroluminescent display panels. FIGS. 18 and 19 show side and top views, respectively, of a display panel 152 according to the invention. The display 152 has a plurality of field emitters 154, one for each pixel in the display 152. The field emitters 154 preferably comprise a material with high electrical conductivity and low emission work function, such as tungsten or molybdenum wire. The tips of the field emitters 154 are preferably formed by micromachining. The field emitters 154 are mounted in an insulative substrate 156 that fixes them in a substantially parallel spaced relationship with each other to form a pattern that corresponds to the pattern of pixels of the display 152. Alternately, a small array of field emitters 154 can energize each single pixel element to provide redundancy. The substrate 156 preferably comprises a material with good mechanical strength and electrical resistivity, such as glass or a printed circuit board.

The tips of the field emitters 154 are proximate a substantially planar electroluminescent phosphor layer 158 that is supported by a substantially transparent display screen 160. The display screen 160 preferably comprises an optically transparent material with high mechanical strength, such as glass. The display screen 160 is preferably coated with $InSnO_2$ or $InO_2$, and the electroluminescent phosphor layer 158 is applied to the coating on the display screen 160 to provide a reasonable degree of electrical conductivity.

The insulative substrate 156 and the display screen 160 are held in a substantially parallel spaced relationship by a spacer ring 162. The spacer ring 162 is preferably fixed to the insulative substrate 156 and display screen 162 such as by thermal bonding, to maintain a vacuum-tight chamber 164 between them.

A plurality of electrically conductive buses 166 are arranged in rows, with each row of the field emitters 154 coupled to a different one of the buses 166, such as by reflow soldering. The buses 166 preferably comprise a highly conductive material that is easily bonded to the field emitters 154, such as tungsten, molybdenum or copper thin films.

A plurality of control gates 168 are arranged along an inward substantially planar surface 170 of the substrate 156. The control gates comprise strips of a highly conductive material, such as tungsten, molybdenum or copper, that each have a plurality of apertures 172. The control gates 168 are arranged in columns, with each column of the field emitters 154 protruding through respective apertures 172 of a different one of the control gates 168. The length of the field emitters 154 and the thickness of the substrate 156 are proportioned to provide the same triode operation characteristics as for the triode 26 described above in connection with FIG. 2.

Field emission for any selected row of field emitters 154 is initiated and sustained by applying a high value of positive potential to the conductive phosphor layer 158 relative to the bus 166 connected to the selected row of field emitters 154. Field emission by a selected one of the field emitters 154 in the selected row is increased or decreased by applying a positive or negative potential relative to the selected field emitter 154 to a selected one of the control gates 168 that has an aperture 172 through which the selected field emitter 154 protrudes. The electrophosphorescence of the phosphor layer 158 due to the emission of the selected field emitter 154 is easily controlled by modulating the potential applied to the selected control gate 168.

It will be evident to those skilled in the art that the potentials applied to the buses 166 and the control gates 168 may be switched in an array to provide a display for television images using standard video formats. For instance, using the NTSC 525 line system for monochrome reproduction, the display panel 152 preferably comprises 367,500 field emitters 154 arranged in a 525 by 700 pixel array, 525 buses 166 and 700 control gates 168. The buses 166 may be switched at a 15,750 Hz rate and the control gates 168 at a 7.14 MHz rate. It will also be apparent to those skilled in the art that the phosphor layer 158 may comprise a tri-color phosphor layer and the number of the field emitters 154 and the control gates 168 may be changed to reproduce full color television images.

Figure 20:
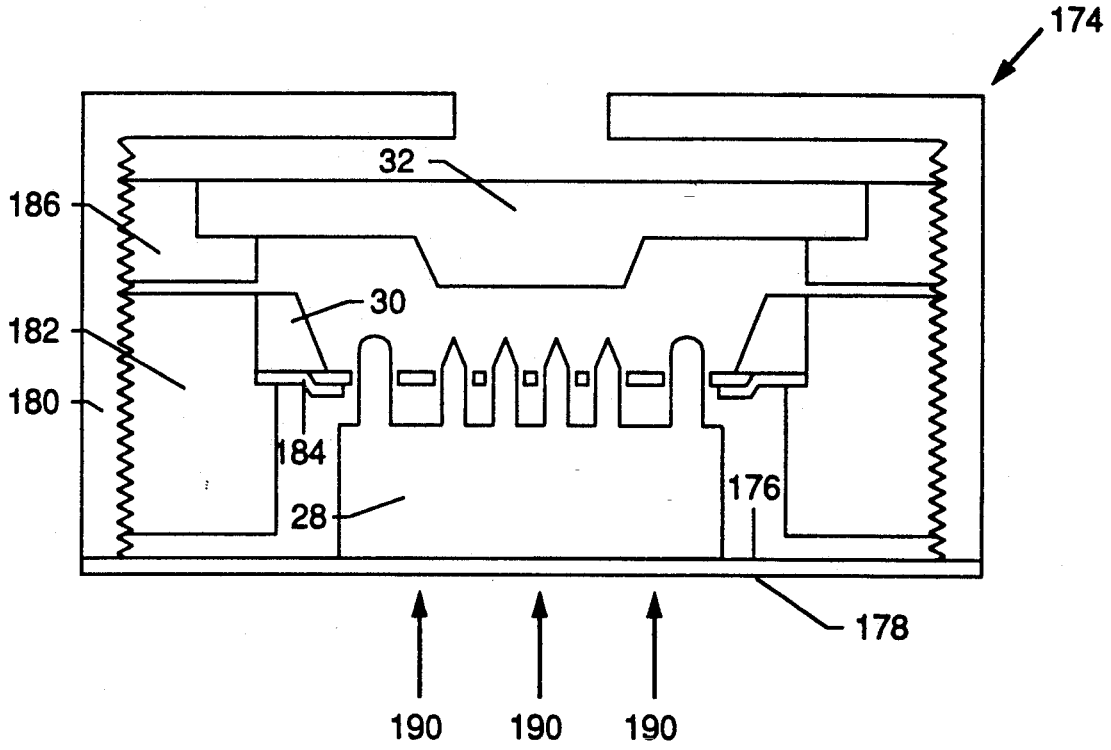
FIG. 20 is a side view of a third alternate embodiment of the invention.

The invention is also ideal for pressure sensing transducers since the invention provides field emission that is independent of ambient temperature up to several hundred °C. FIG. 20 shows a pressure sensor 174 according to the invention that is usable for even high pressure sensing under widely varying ambient temperature conditions. The sensor 174 comprises the emitter substrate 28, the control gate substrate 30 and the collector 32 described above for the triode 26 in connection with FIG. 2.

However, the emitter substrate 28 is preferably mounted on an outward surface 176 of a substantially disc shaped diaphragm 178. The diaphragm preferably comprises a material with high mechanical strength, corrosion resistance and electrical conductivity, such as nickel or stainless steel. The outer periphery of the emitter gate substrate 30 is preferably mounted to a substantially cylindrical sensor body 180. The body preferably comprises a material having high mechanical strength, corrosion resistance and electrical conductivity, such as nickel.

An insulative, substantially ring shaped spacer 182 is mounted along the outer periphery the outward surface 176 of the diaphragm 178 between the inner surface of the body 180 and the outer periphery of the gate control substrate 30 to maintain a substantially parallel spaced relationship between the control gate layer 44 and the outward surface 36 of the emitter substrate 28. The thickness of the spacer 182 is sized to allow the field emitters 34 and the alignment pins 38 to protrude through their respective apertures 52 and 56 in the control gate membrane 42.

The spacer 182 preferably comprises a material that has high electrical resistance such as machinable ceramic. The spacer 182 is preferably threaded into the body 180 to provide a rigid mount that has a degree of adjustability to allow the protrusion of the field emitters 34 through the apertures 52 in the control gate membrane 42 to be changed.

A stop diaphragm 184 is preferably mounted within the body 180 to limit outward travel of the emitter substrate 28. The stop diaphragm 184 preferably comprises a material with high electrical resistance and mechanical strength, such as $SiO_2$. An insulative, substantially ring shaped spacer 186 is mounted adjacent the spacer ring 182 between the inner surface of the body 180 and the outer periphery of the collector 32. The spacer 186 preferably comprises a material that has high electrical resistance such as machinable ceramic. The spacer 186 is preferably threaded into the body 180 to provide a rigid mount that has a degree of adjustability to allow the spacing of the emission surface of the field emitters 34 from the collector 32 to be changed.

An inward surface 188 of the diaphragm 178 is used for sensing pressure, as represented by arrows 190. Increasing pressure causes the field emitters 34 to increase their protrusion through the control gate layer 44. If the control gate layer 44 is maintained at a negative potential relative to the field emitters 34, field emission through the collector 32 will increase dramatically, thus providing high sensitivity and resolution. The stop diaphragm 184 prevents the emitter substrate 28 from shorting to the control gate substrate 30 when the sensor 170 is exposed to excessive pressure.

Figure 21:
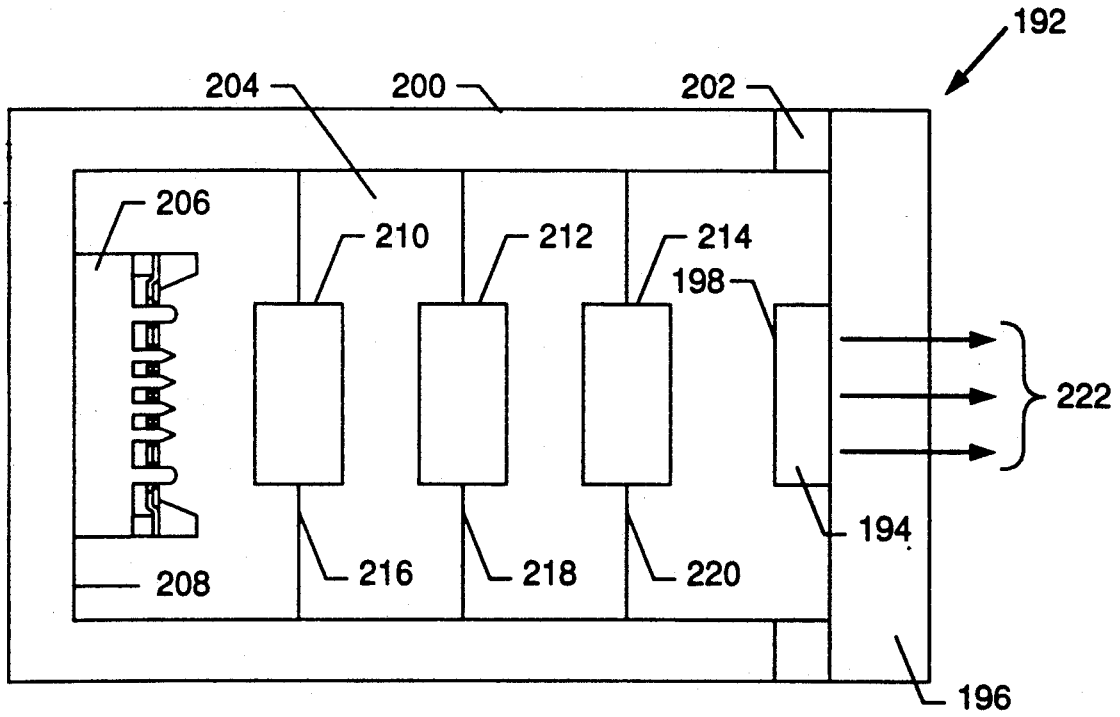
FIG. 21 is a side view of a fourth alternate embodiment of the invention.

The invention is also applicable to electron sources for electron beam pumped solid state lasers. In this application, an electron source may be switched or modulated by high frequency input signals without significant input signal loading. An end pumped laser system 192 comprising an electron source according to the invention is shown in FIG. 21.

The laser system 192 comprises a suitable active lasing device 194, such as cadmium selenide (CdSe), cadmium sulfide (CdS), zinc oxide (ZnO), gallium arsenide (GaAs) or a superlattice device, that is mounted to a suitable optical window 196. The active device 194 has a thickness and polished mirror faces 198 that promote lasing at a selected wavelength. The optical window 196 is preferably a substantially planar disc shaped plate that preferably comprises a material with high thermal conductivity and relatively high transmissivity at the selected lasing wavelength.

The faces 198 are aligned to be substantially parallel to the planar surfaces of the window 196, and one of the faces 198 is preferably mounted directly to one of the planar surfaces of the window 196. A substantially cylindrical electron source body 200 having one closed end has its open end coupled to the planar surface of the window 196 on which the active device 194 is mounted with a substantially ring shaped vacuum seal 202. A vacuum chamber 204 is formed therein. An electron source assembly 206, comprising the emitter substrate 28, the spacer 54 and the control gate substrate 30 of the triode described in connection with FIG. 2, is mounted within the chamber 204 along a substantially planar surface 208 of the closed end of the body 200.

Electrodes 210, 212 and 214, retained within the chamber 204 between the source 206 and the active device 194 by insulative spacers 216, 218 and 220, respectively, replace the collector 32 of the triode 26 to initiate, sustain, and focus a beam of electrons produced by field emission from the field emitters 34 of emitter substrate 28 in the source 206. The electron beam so produced is focused on the active device 194 and adjusted in intensity to provide electron beam induced pumping of the active device due to electron-hole pairs generated by electron collision. Light produced by the active device 194 radiates through the window 196 as represented by arrows 222.

A control signal applied to the control gate layer 44 of the control gate substrate 30 in the source 206 may be used to modulate the electron beam that pumps the active device 194. The electron source 206 has all the advantages of the triode 26 with respect to enhanced high frequency modulation and switching control.

Thus there has been described herein methods and apparatus for providing signal modulation or control of collector initialized and sustained field emission in field emitter devices without input circuit loading. It will be understood that various changes in the details, materials, steps and arrangements of parts that have been described and illustrated above in order to explain the nature of the invention may be made by those of ordinary skill in the art within the principle and scope of the present invention as expressed in the appended claims.

What is claimed is:

1. A method of modulating collector current in a field emitter device comprising an emitter and a collector in proportion to an information signal, comprising the steps of:

applying a positive potential to said collector relative to said emitter to initiate and sustain field emission between said emitter and said collector along a field emission path;

positioning a control gate outside said field emission path by spacing said control gate further from said collector than the distance of the emitter surface of said emitter from said collector to prevent significant emission between said emitter and said control gate with a potential applied to said control gate; and applying an information signal potential to said control gate relative to said emitter to modulate said field emission between said emitter and said collector in proportion to said information signal potential.

2. The method set forth in claim 1, wherein the step of positioning said control gate comprises the step of protruding the emission surface of said emitter through an aperture in said control gate.

3. The method set forth in claim 1, wherein the step of positioning said control gate comprises the step of protruding the emission surface of said emitter through a gap between sections of said control gate.

4. The method set forth in claim 1, wherein the step of applying said information signal potential comprises the application of positive information signal potential relative to said emitter.

5. The method set forth in claim 1, wherein the step of applying said information signal potential comprises the application of negative control potential relative to said emitter.

6. A field emitter device for modulating output current in proportion to an information signal, comprising:

at least one field emitter to provide a source of field emission current;

a collector that has an applied positive potential relative to said emitter to initiate and sustain field emission current from said field emitter along a field emission path; and at least one control gate positioned away from said field emission path and spaced a greater distance from said collector than the spacing of the emission surface of said field emitter from said collector that has an applied information signal potential relative to said emitter to modulate said field emission current in proportion to said information signal potential.

7. The field emitter device set forth in claim 6, wherein said emitter protrudes through an aperture in said control gate.

8. The field emitter device set forth in claim 6, wherein said emitter protrudes through a gap between sections of said control gate.

9. The field emitter device set forth in claim 6, wherein said collector is a phosphor screen of a display panel.

10. The field emitter device set forth in claim 9, wherein said device comprises a plurality of said emitters and a plurality of said control gates.

11. The field emitter device set forth in claim 9, wherein said emitters and control gates are arrayed to control pixels of a display on said phosphor screen of said display panel.

12. The field emitter device set forth in claim 6, wherein said emitter is coupled to a moving element in a mechanical transducer to vary the spacing between the emission surface of said emitter, said control gate and said collector in proportion to the motion of said moving element of said mechanical transducer.

13. The field emitter device set forth in claim 6, further comprising a lasant material positioned within at least a portion of said field emission path to be pumped by said field emission.

14. A method of modulating collector current in a field emitter device comprising an emitter and a collector in proportion to an information signal, comprising the steps of:

applying a positive potential to said collector relative to said emitter to initiate and sustain field emission between said emitter and said collector along a field emission path;

positioning a control gate outside said field emission path to prevent significant emission between said emitter and said control gate with a potential applied to said control gate; and applying an information signal potential to said emitter relative to said control gate to modulate said field emission between said emitter and said collector in proportion to said information signal potential.

15. A field emitter device for modulating output current in proportion to an information signal, comprising:

at least one field emitter to provide a source of field emission current that has an applied information signal potential;

a collector that has an applied positive potential relative to said emitter to initiate and sustain field emission current from said field emitter along a field emission path; and at least one control gate positioned away from said field emission path and spaced a greater distance from said collector than the spacing of the emission surface of said field emitter from said collector that has an applied steady-state potential relative to said information signal potential to permit said emitter to modulate said field emission current in proportion to said information signal potential.

16. The field emitter device set forth in claim 15, wherein said emitter protrudes through an aperture in said control gate.

17. The field emitter device set forth in claim 15, wherein said emitter protrudes through a gap between sections of said control gate.

18. The field emitter device set forth in claim 15, wherein said collector is a phosphor screen of a display panel.

19. A field emitter device for modulating output current in proportion to a mechanical information signal, comprising:

at least one field emitter to provide a source of field emission current;

a collector that has an applied positive potential relative to said emitter to initiate and sustain field emission current from said field emitter along a field emission path; and at least one control gate positioned away from said field emission path and spaced a greater distance from said collector than the spacing of the emission surface of said field emitter from said collector that has an applied potential relative to said emitter to permit said mechanical information signal applied to said emitted to modulate said emission current.

20. A field emitter device for modulating output current in proportion to a mechanical information signal, comprising:

at least one field emitter to provide a source of field emission current;

a collector that has an applied positive potential relative to said emitter to initiate and sustain field emission current from said field emitter along a field emission path; and at least one control gate positioned away from said field emission path and spaced a greater distance from said collector than the spacing of the emission surface of said field emitter from said collector that has an applied potential relative to said emitter to permit said mechanical information signal applied to one of a group of device elements comprising said emitter, said control gate and said collector to modulate said field emission current.

* * * * *